US010881204B2

(12) United States Patent
Chen et al.

(10) Patent No.: US 10,881,204 B2
(45) Date of Patent: Jan. 5, 2021

(54) DRAWER AND FURNITURE FITTINGS THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Fang-Cheng Su, Kaohsiung (TW); Ci-Bin Huang, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); Kins Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/567,329

(22) Filed: Sep. 11, 2019

(65) Prior Publication Data

US 2020/0359791 A1 Nov. 19, 2020

(30) Foreign Application Priority Data

May 15, 2019 (TW) ..... 108117030 A

(51) Int. Cl.
*A47B 88/95* (2017.01)
*A47B 88/90* (2017.01)

(52) U.S. Cl.
CPC ..... *A47B 88/95* (2017.01); *A47B 88/941* (2017.01); *A47B 2088/951* (2017.01); *A47B 2088/952* (2017.01)

(58) Field of Classification Search
CPC . A47B 88/95; A47B 88/941; A47B 2088/951; A47B 2088/952
See application file for complete search history.

(56) References Cited

U.S. PATENT DOCUMENTS 3,610,720 A * 10/1971 Hosmer ..... A47B 88/941 312/330.1
3,752,553 A * 8/1973 Bildahl ..... F16B 12/26 312/265.1
3,933,402 A * 1/1976 Peterson ..... A47B 88/906 312/265.1
4,042,288 A * 8/1977 Litchfield ..... A47B 88/941 312/348.2

(Continued)

FOREIGN PATENT DOCUMENTS

DE 112009000135 A5 4/2011
EP 0698357 A1 2/1996
JP 07143919 A * 6/1995 ..... A47B 88/941

OTHER PUBLICATIONS

Search Report Issued by a Foreign Patent Office in Application No. 19204038.4.

*Primary Examiner* — Hanh V Tran
(74) *Attorney, Agent, or Firm* — Rosenberg, Klein & Lee

(57) ABSTRACT

A drawer and its furniture fittings are provided. The furniture fittings include a first wall, a second wall, and a mounting device. The second wall is provided with a first structure, and the mounting device is provided with a second structure. The second structure of the mounting device and the first structure of the second wall are detachably engaged with each other without using tools. The second wall is mounted on the first wall through the mounting device.

20 Claims, 10 Drawing Sheets

(56) References Cited

U.S. PATENT DOCUMENTS

| | | | | | |
|---|---|---|---|---|---|
| 4,913,580 | A * | 4/1990 | Whitehead | B65H 75/403 | 137/355.27 |
| 5,588,730 | A * | 12/1996 | Rock | A47B 88/941 | 312/263 |
| 5,611,637 | A * | 3/1997 | Brustle | A47B 88/00 | 403/297 |
| 5,823,650 | A | 10/1998 | Lin | | |
| 5,895,103 | A | 4/1999 | Huber | | |
| 6,409,293 | B1 * | 6/2002 | Chang | A47B 47/02 | 312/257.1 |
| 8,727,461 | B2 | 5/2014 | Holzapfel et al. | | |
| 8,801,123 | B2 | 8/2014 | Kueng | | |
| 8,931,862 | B2 * | 1/2015 | Grimm | A47B 88/40 | 312/348.2 |
| 2001/0050518 | A1 * | 12/2001 | Liebertz | A47B 63/00 | 312/263 |
| 2007/0159039 | A1 * | 7/2007 | Lam | A47B 88/941 | 312/348.1 |
| 2014/0225493 | A1 | 8/2014 | Gasser et al. | | |
| 2017/0318963 | A1 * | 11/2017 | Schon | A47B 88/941 | |
| 2018/0206636 | A1 * | 7/2018 | Held | A47B 88/941 | |

* cited by examiner

DRAWER AND FURNITURE FITTINGS THEREOF

FIELD OF THE INVENTION

The present invention relates to a drawer and its furniture fittings. More particularly, the invention relates to a technique by which a wall of a drawer and a mounting device of the drawer can be connected without using tools.

BACKGROUND OF THE INVENTION

US Published Patent Application No. 2014/0225493 A1 discloses a piece of furniture that includes a plurality of drawers whose front panels are of the same type. The front panel of each drawer is connected to the lateral walls of the drawer through the fittings on the front panel. More specifically, each front panel includes a plurality of screws in addition to the fittings, and the fittings cannot be fixed on the front panel without using a screwdriver to tighten the screws.

The furniture disclosed in the aforesaid patent application uses a mounting means that entails locking screws to a front panel in order to fix the corresponding fittings on the front panel. During the assembly process, however, tool operation tends to inconvenience an assembly worker.

SUMMARY OF THE INVENTION

The present invention relates to a drawer and its furniture fittings. The drawer includes a wall and a mounting device that are connected in a tool-free manner.

According to one aspect of the present invention, a set of furniture fittings include a first wall, a second wall, and a mounting device. The second wall is provided with a first structure, and the mounting device is provided with a second structure. The first structure and the second structure are detachably engaged with each other in a tool-free manner. The second wall is mounted on the first wall via the mounting device.

Preferably, the set of furniture fittings further include a connection device disposed on the first wall. The connection device is configured to connect with the mounting device.

Preferably, the mounting device includes a pin, and the connection device includes a fastening member configured to be fastened to the pin.

Preferably, the first wall is a sidewall of a drawer, and the second wall is the front panel of the drawer.

Preferably, the second wall includes a first portion, a second portion, and a middle portion connected between the first portion and the second portion, and either the first portion or the second portion is provided with the first structure.

Preferably, one of the first structure and the second structure includes at least one projection, and the other of the first structure and the second structure includes at least one hole configured to work with the at least one projection.

Preferably, the at least one projection has a first section and a second section bent with respect to the first section, wherein the first section and the second section are configured to be inserted into the at least one hole and engage with the hole wall of the at least one hole.

Preferably, one of the second wall and the mounting device includes a second projection, wherein the second projection includes an elastic section and a supporting section connected to the elastic section, the supporting section being configured to support the other of the second wall and the mounting device.

Preferably, the first portion and/or the second portion is threadedly connected to the middle portion.

Preferably, the first portion and/or the second portion includes a plate body and a connecting section, wherein the connecting section is substantially perpendicularly connected to the plate body and is connected to a lateral side of the middle portion via a screw.

According to another aspect of the present invention, a drawer includes a bottom panel, a pair of first walls, a rear wall, a second wall, and at least one mounting device. The pair of first walls are disposed adjacent to two lateral sides of the bottom panel respectively. The rear wall is disposed adjacent to a rear side of the bottom panel. The second wall is disposed adjacent to a front side of the bottom panel and is provided with at least one first structure. Each of the at least one mounting device is provided with a second structure. The at least one second structure of the at least one mounting device is engaged with the at least one first structure of the second wall in a tool-free manner. The second wall is mounted on at least one of the pair of first walls via the at least one mounting device.

DETAILED DESCRIPTION OF THE INVENTION

Figure 1:
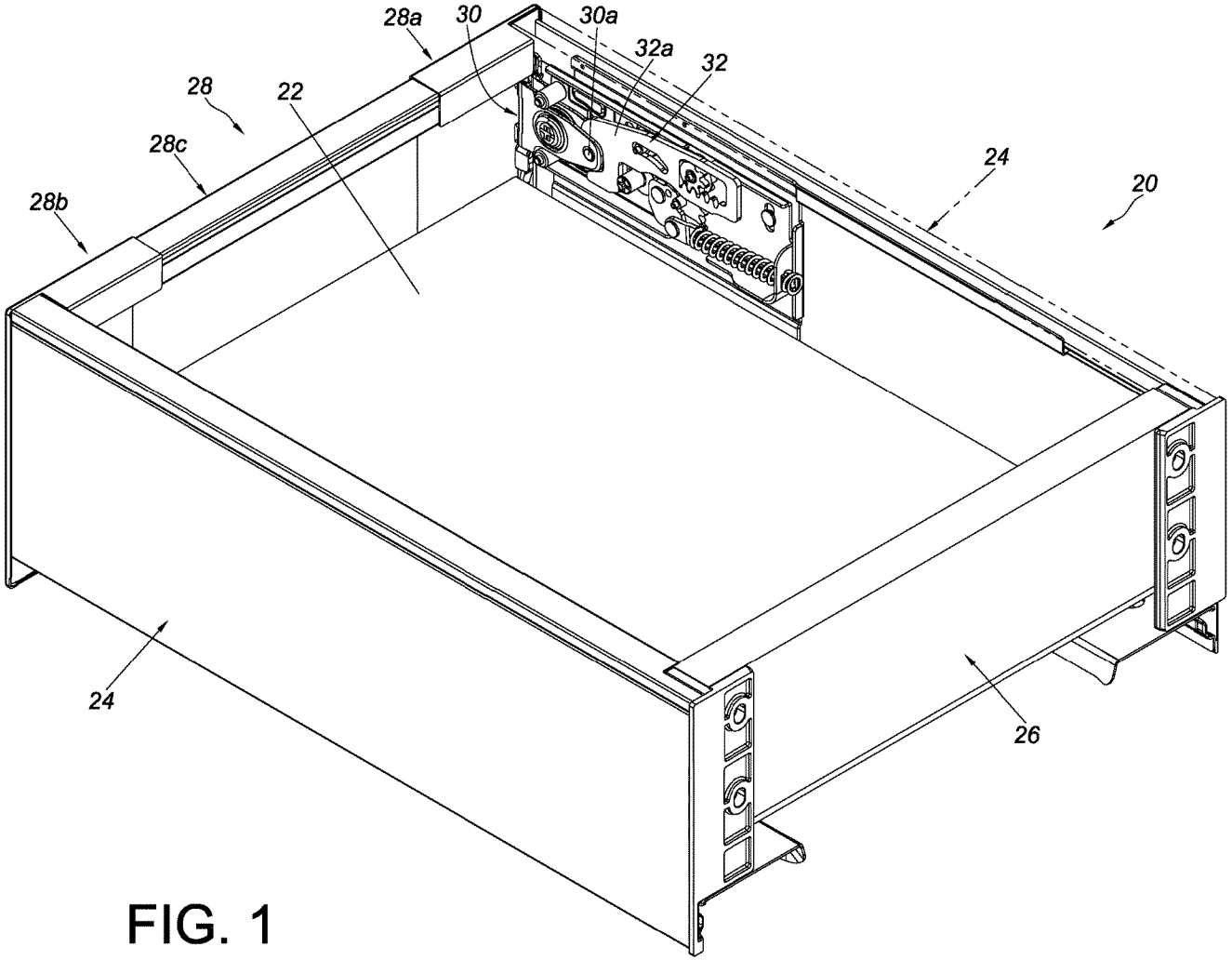
FIG. 1 is a perspective view of the drawer according to an embodiment of the present invention.
Figure 2:
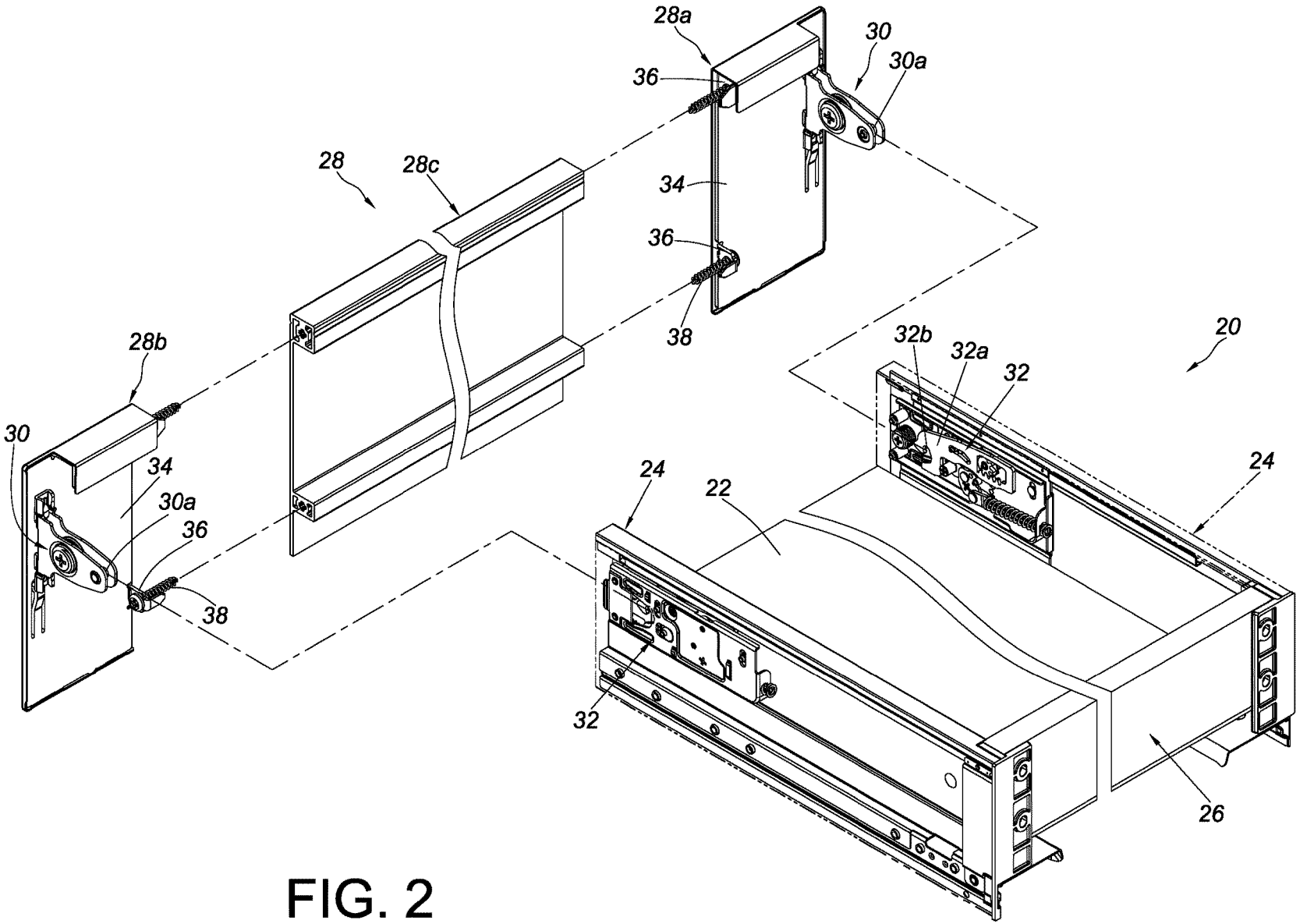
FIG. 2 is an exploded perspective view of the drawer according to the embodiment of the present invention, showing the second wall detached from the main body of the drawer.

Referring to FIG. 1 and FIG. 2, the drawer 20 according to an embodiment of the present invention includes a bottom panel 22, a pair of first walls 24, a rear wall 26, and a second wall 28. The foregoing components can be viewed as furniture fittings before they are put together to form the drawer 20.

The pair of first walls 24 are disposed adjacent to the two lateral sides (e.g., the left side and the right side) of the bottom panel 22 respectively. The rear wall 26 is disposed adjacent to the rear side of the bottom panel 22, and the second wall 28 is disposed adjacent to the front side of the bottom panel 22. The second wall 28 is mounted on the connection device 32 on one of the first walls 24 in a detachable manner through a mounting device 30. Preferably, the second wall 28 is provided with a pair of mounting devices 30, and each of the first walls 24 is provided with a connection device 32, wherein each mounting device 30 is configured to be mounted on the corresponding connection device 32 in a detachable manner; in other words, each connection device 32 is configured to connect with the corresponding mounting device 30. Preferably, each mounting device 30 includes a pin 30*a*, and each connection device 32 includes a fastening member 32*a* with a fastening portion 32*b*. The fastening portion 32*b* of each fastening member 32*a* is configured to be fastened to the corresponding pin 30*a* securely.

More specifically, the pair of first walls 24 are the sidewalls of the drawer 20, and the second wall 28 is the front panel of the drawer 20. The second wall 28 includes a first portion 28*a*, a second portion 28*b*, and a middle portion 28*c*. The middle portion 28*c* is connected between the first portion 28*a* and the second portion 28*b*. Preferably, the first portion 28*a* and the second portion 28*b* are threadedly connected to the two lateral sides (e.g., the left side and the right side) of the middle portion 28*c* respectively. The first portion 28*a* and the second portion 28*b* have substantially the same structural configuration. For example, both the first portion 28*a* and the second portion 28*b* include a plate body 34 and a connecting section 36, wherein the connecting section 36 is substantially perpendicularly connected to the plate body 34 and is connected to a lateral side of the middle portion 28*c* through a screw 38.

Figure 4:
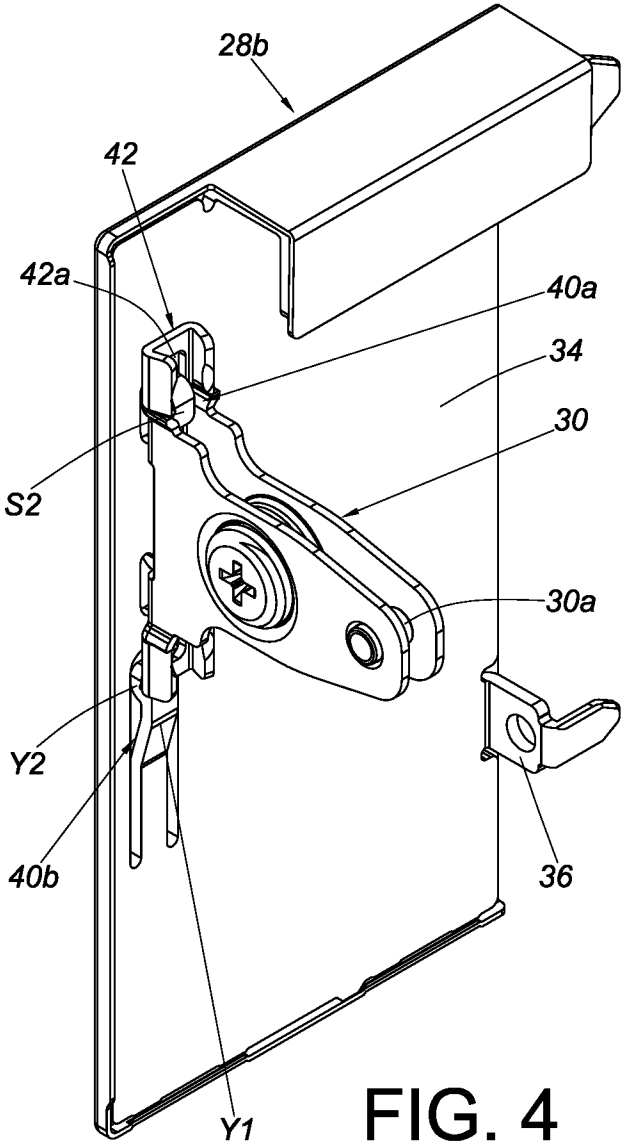
FIG. 4 is an assembled perspective view of the portion of the second wall and the mounting device according to the embodiment of the present invention.
Figure 3:
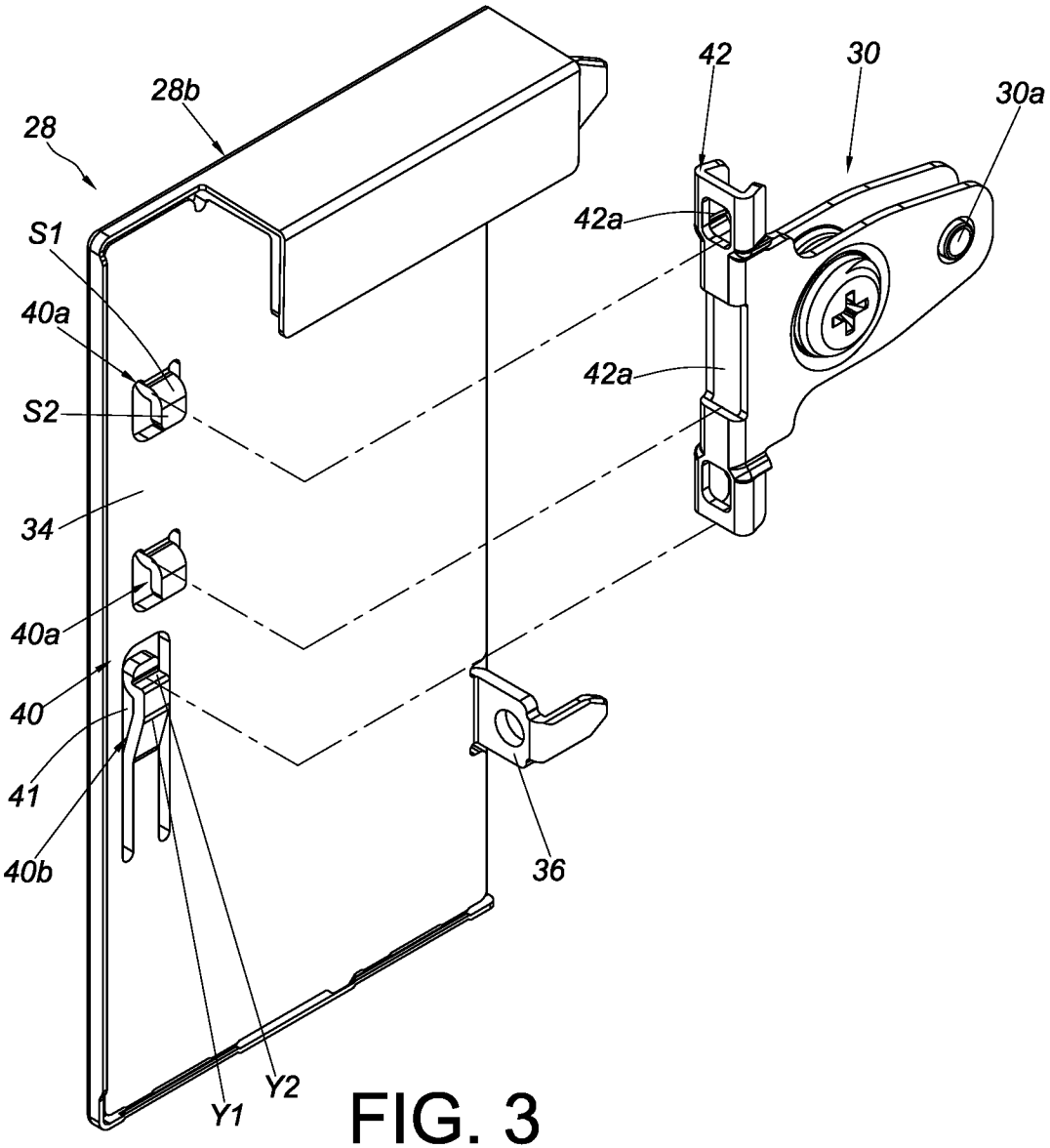
FIG. 3 is an exploded perspective view of a portion of the second wall of the drawer and a mounting device of the drawer according to the embodiment of the present invention.

Referring to FIG. 3 and FIG. 4, the plate body 34 of the second portion 28*b* of the second wall 28 is provided with a first structure 40, and the corresponding mounting device 30 is provided with a second structure 42. The second structure 42 is configured to engage with the first structure 40 of the second wall 28.

Preferably, one of the first structure 40 and the second structure 42 includes at least one first projection 40*a*, and the other of the first structure 40 and the second structure 42 includes at least one hole 42*a* configured to work with the at least one first projection 40*a*. While FIG. 3 and FIG. 4 show two first projections 40*a* and two holes 42*a*, the following description is directed to only one of the first projections 40*a* and the corresponding hole 42*a* for the sake of brevity, and the present invention has no limitation on the number of the at least one first projection 40*a* or the at least one hole 42*a*. The first projection 40*a* in this embodiment has a first section S1 and a second section S2 bent with respect to the first section S1. Preferably, the second section S2 is bent in such a way that it is substantially perpendicular to the first section S1. Preferably, one of the second wall 28 and the mounting device 30 (e.g., the second wall 28) includes a second projection 40*b*, and the second projection 40*b* includes an elastic section Y1 and a supporting section Y2 connected to the elastic section Y1. Here, and by way of example only, the elastic section Y1 is raised at an angle with respect to the plane in which the plate body 34 of the second wall 28 lies. Preferably, the plate body 34 of the second wall 28 has an opening 41 corresponding in position to the second projection 40*b*.

Figure 5:
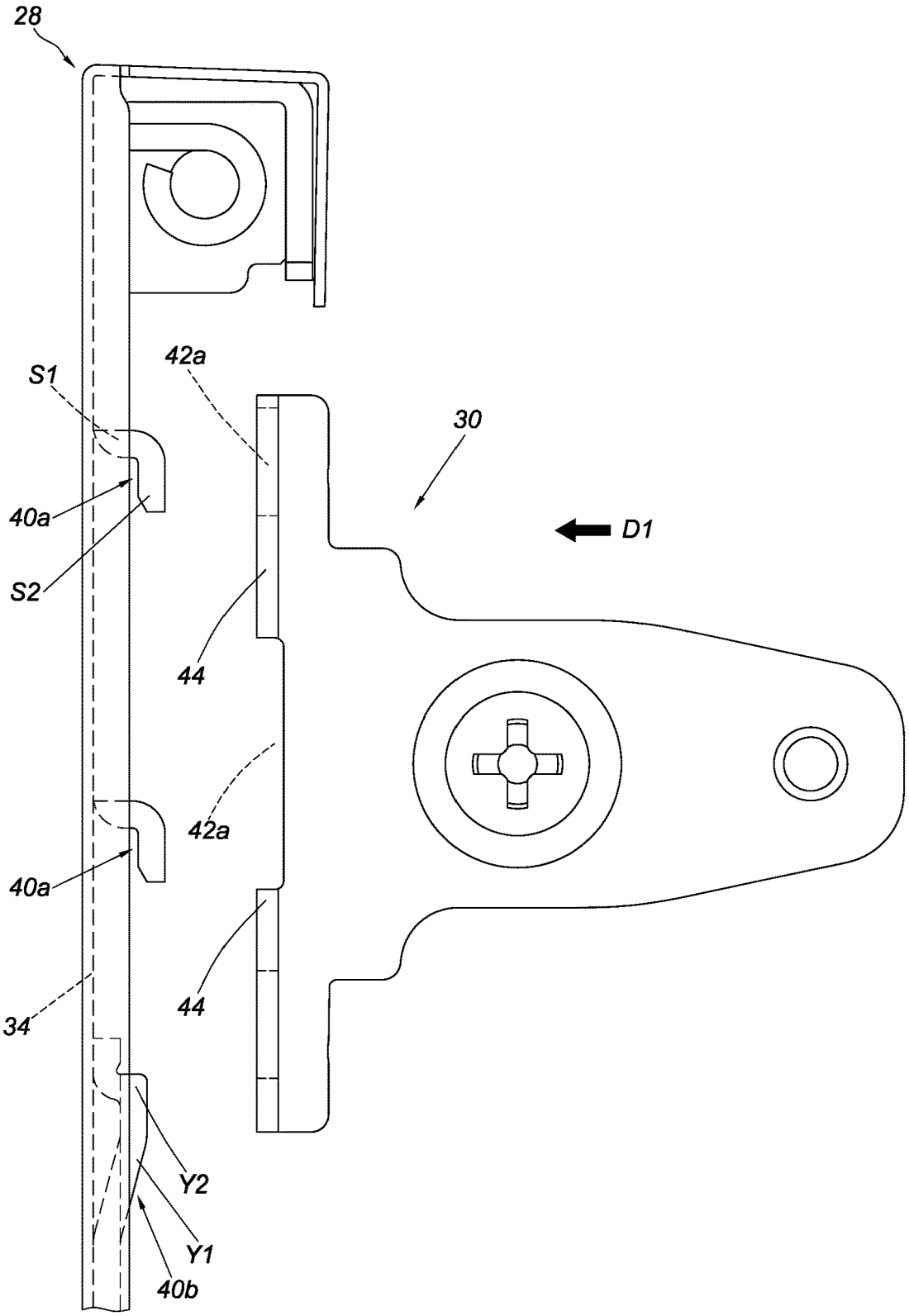
FIG. 5 is an exploded schematic view of the portion of the second wall and the mounting device according to the embodiment of the present invention.
Figure 6:
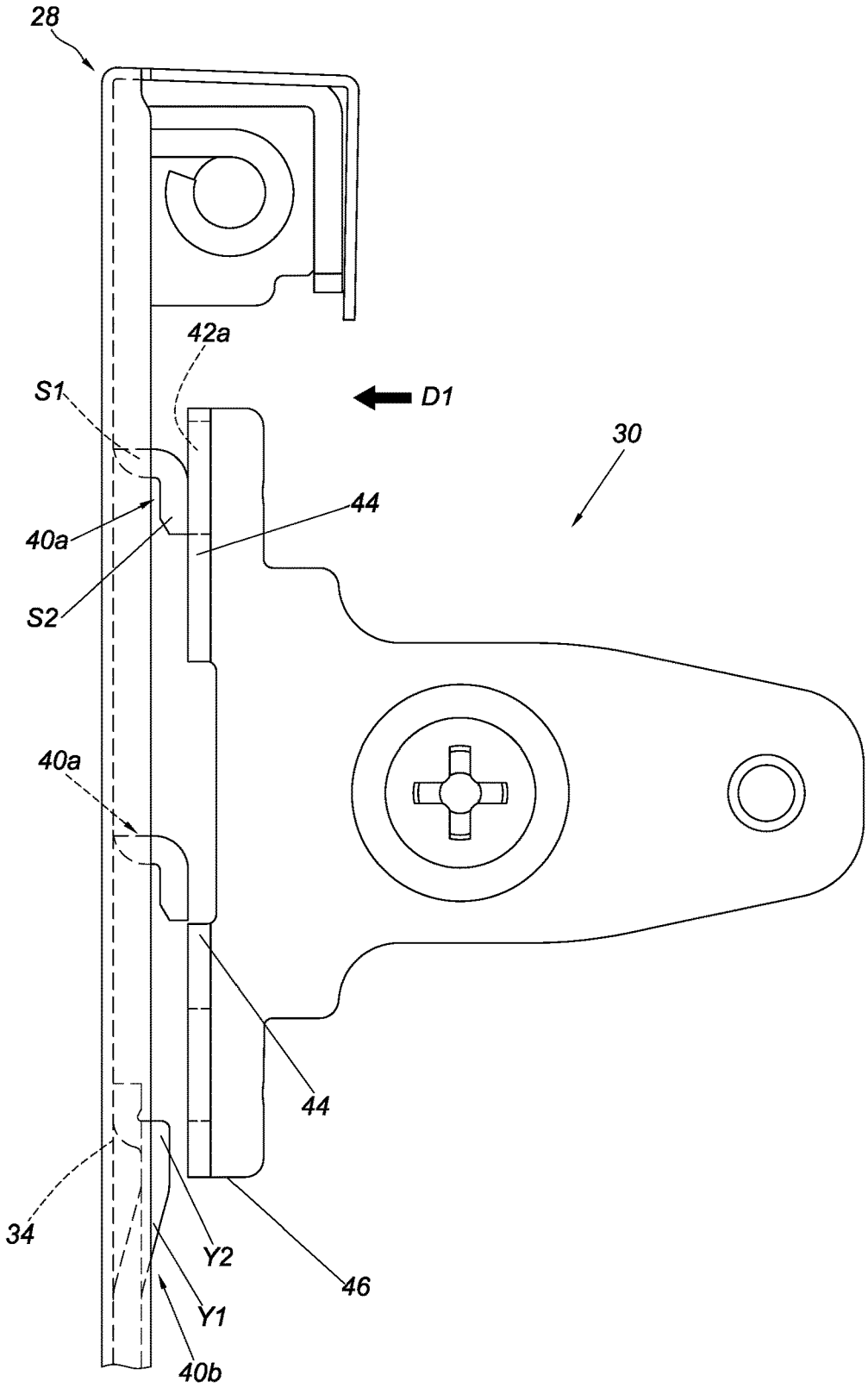
FIG. 6 is a schematic view showing how the mounting device is mounted on the portion of the second wall according to the embodiment of the present invention.
Figure 7:
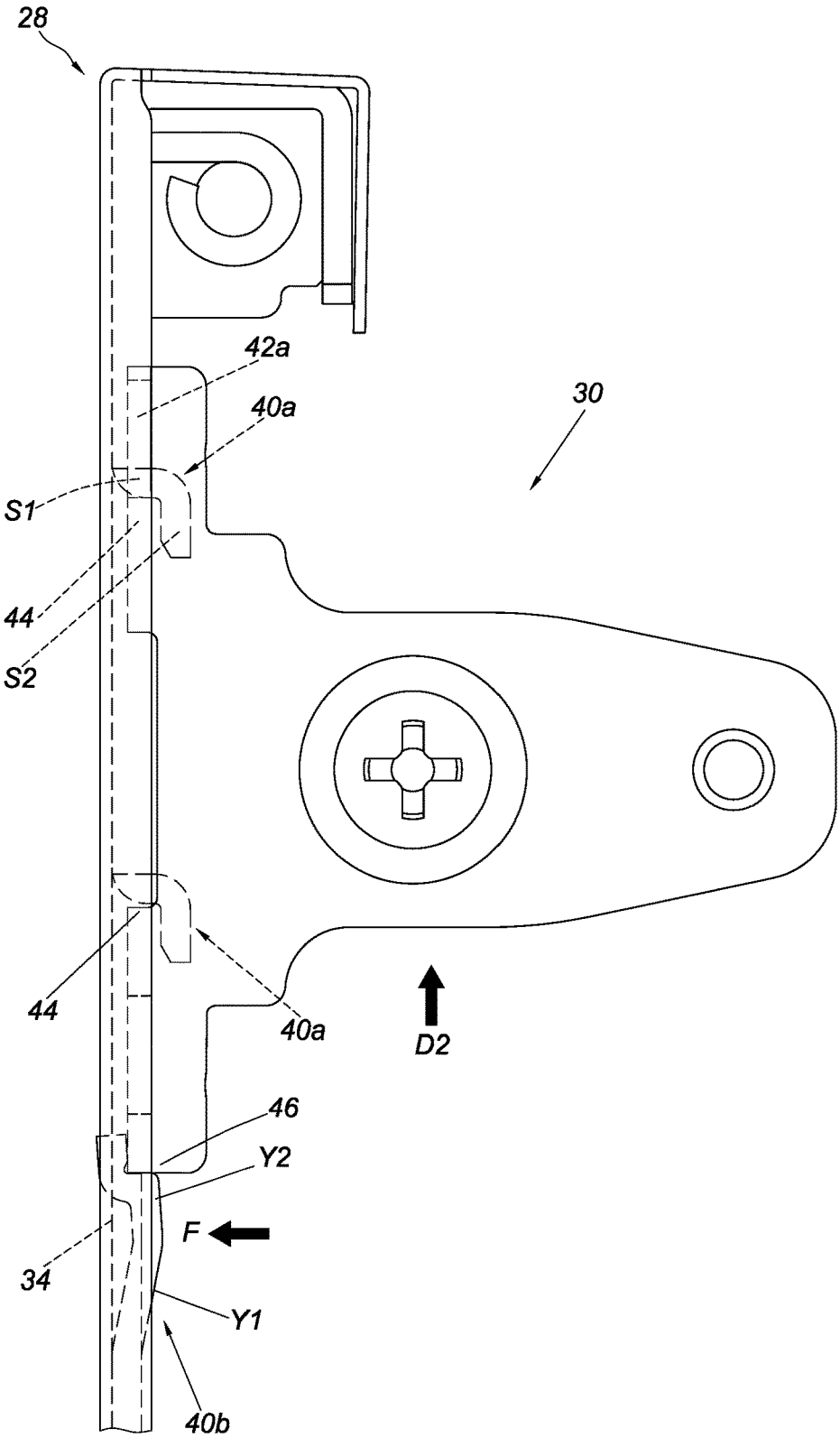
FIG. 7 is a schematic view in which the mounting device is mounted on the portion of the second wall according to the embodiment of the present invention.

Referring to FIG. 5, FIG. 6, and FIG. 7, the second wall 28 and the mounting device 30 can be mounted on each other in a detachable manner. FIG. 5 to FIG. 7 schematically show the process of mounting the mounting device 30 on the second wall 28 (rather than the other way around) for illustrative purposes only.

To begin with, the mounting device 30 is moved toward the second wall 28 in a first direction D1, with the hole 42*a* of the mounting device 30 in alignment with the first projection 40*a* of the second wall 28 (see FIG. 5 and FIG. 6). Once the first section S1 of the first projection 40*a* of the second wall 28 is received in the hole 42*a* of the mounting device 30, the elastic section Y1 of the second projection 40*b* of the second wall 28 generates an elastic force due to the pressure applied by the mounting device 30 to the elastic section Y1. When the mounting device 30 is subsequently moved in a second direction D2 with respect to the second wall 28 (see FIG. 7), the elastic section Y1 of the second projection 40*b* of the second wall 28 releases the elastic force and thereby brings the supporting section Y2 of the second projection 40*b* of the second wall 28 to a position where the supporting section Y2 props the mounting device 30 up to ensure that the mounting device 30 is mounted securely on the second wall 28. The second direction D2 is substantially perpendicular to the first direction D1.

More specifically, when the mounting device 30 is mounted on the second wall 28, the first section S1 and the second section S2 of the first projection 40*a* of the second wall 28 are engaged with the hole wall 44 of the hole 42*a* of the mounting device 30 (see FIG. 7) to prevent the mounting device 30 from being displaced in the second direction D2 with respect to the second wall 28. In the meantime, the supporting section Y2 of the second projection 40*b* supports the other of the second wall 28 and the mounting device 30, e.g., supports a portion 46 of the mounting device 30 (see FIG. 7) to keep the mounting device 30 from being displaced in the opposite direction of the second direction D2 (hereinafter referred to as the third direction D3) with respect to the second wall 28.

Thus, the engagement between the first structure 40 and the second structure 42 allows the mounting device 30 to be connected securely to the second wall 28.

Moreover, thanks to the cooperation between the first structure 40 and the second structure 42, a user can mount the mounting device 30 securely on the second wall 28 without using any tool, and the second wall 28, therefore, can be mounted securely on the connection device 32 of the corresponding first wall 24 through the mounting device 30.

Figure 8:
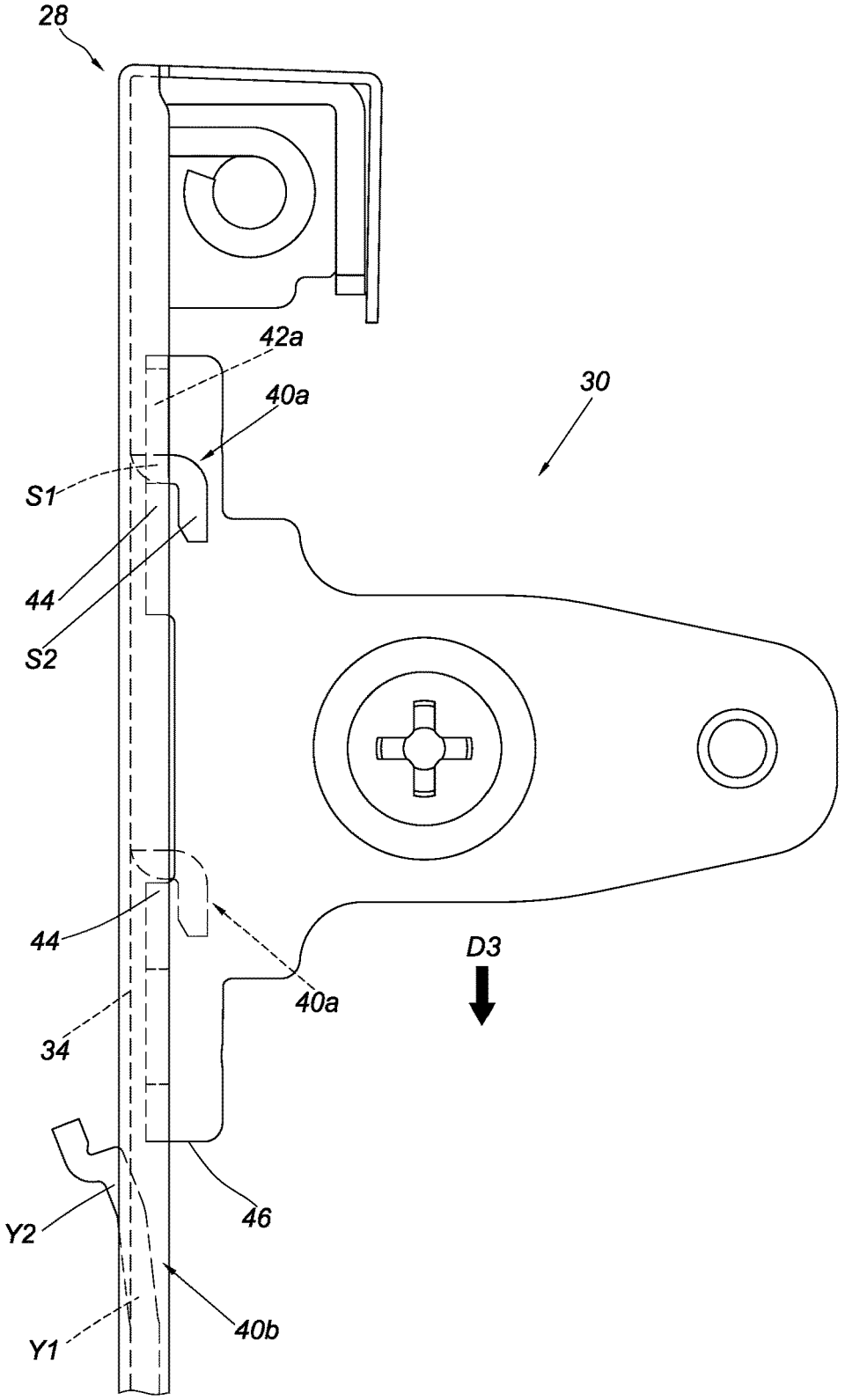
FIG. 8 is a schematic view showing how the mounting device is detached from the portion of the second wall according to the embodiment of the present invention.
Figure 9:
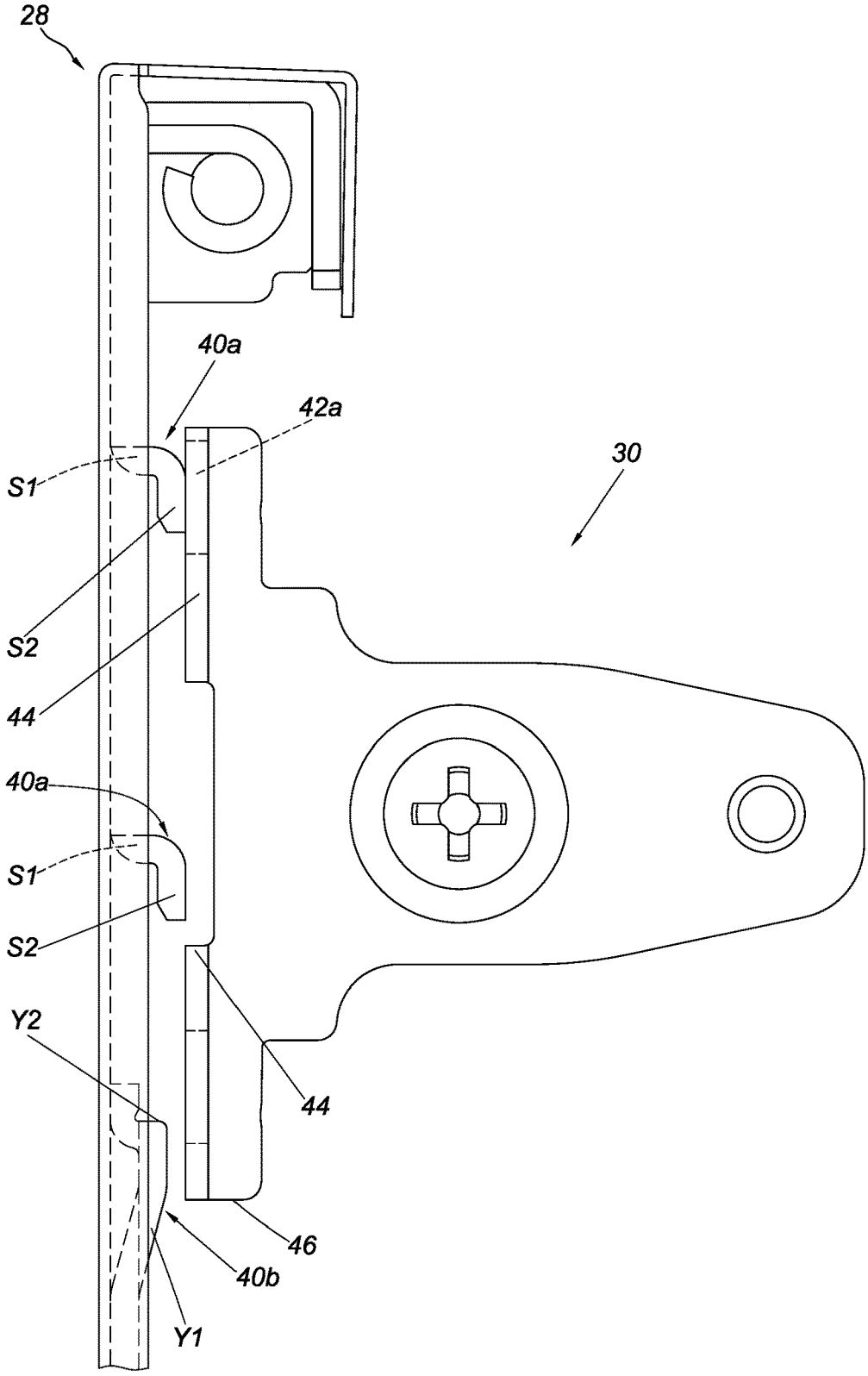
FIG. 9 is a schematic view in which the mounting device is detached from the portion of the second wall according to the embodiment of the present invention.

When it is desired to detach the mounting device 30 from the second wall 28, referring to FIG. 7, FIG. 8, and FIG. 9, a user can apply a force F to the elastic section Y1 of the second projection 40*b* (see FIG. 7) to tilt the elastic section Y1 by an angle with respect to the plane in which the plate body 34 of the second wall 28 lies, and once the elastic section Y1 is so tilted, the supporting section Y2 ceases to support the portion 46 of the mounting device 30 (see FIG. 8). The mounting device 30 in this state can be displaced in the third direction D3 (i.e., the opposite direction of the second direction D2) with respect to the second wall 28 (see FIG. 8), thereby disengaging the hole wall 44 of the hole 42*a* of the mounting device 30 from the first section S1 and the second section S2 of the first projection 40*a* of the second wall 28 (see FIG. 9), allowing the mounting device 30 to be detached from the second wall 28.

Figure 10:
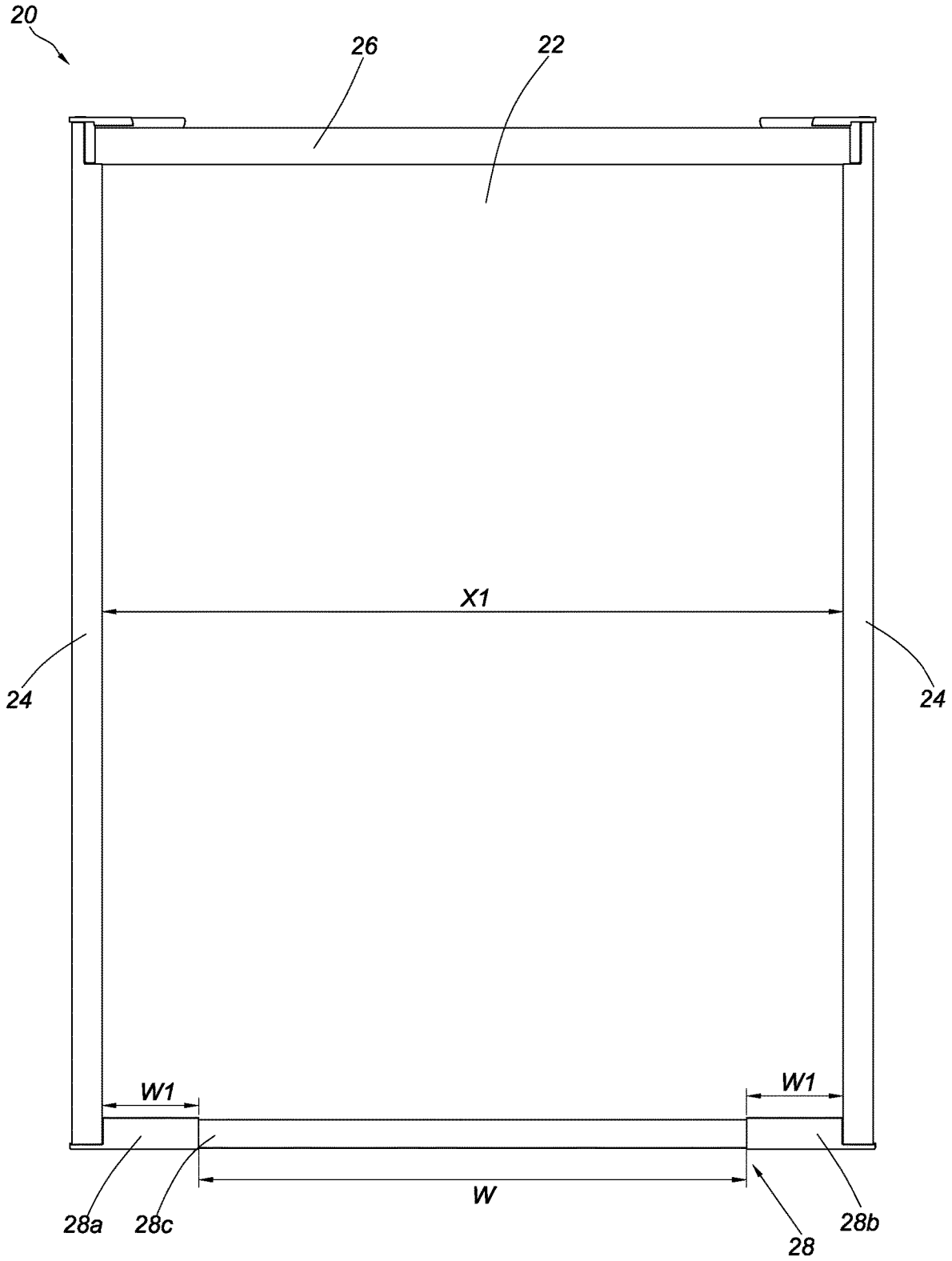
FIG. 10 is a schematic view showing that the second wall of the drawer matches a first drawer width according to the embodiment of the present invention.

Referring to FIG. 10, the bottom panel 22, the pair of first walls 24, the rear wall 26, and the second wall 28 of the drawer 20 jointly define a space. The first portion 28*a* and the second portion 28*b* of the second wall 28 are connected to the two lateral sides of the middle portion 28*c* respectively in a threaded manner (see FIG. 2). The middle portion 28*c* in this embodiment has a standard width W, and a user may choose a first portion 28*a* and a second portion 28*b* of a first predetermined width W1 in order for the total width of the second wall 28 (mathematically expressed as W+2W1) to match a first width X1 defined by the pair of first walls 24.

Figure 11:
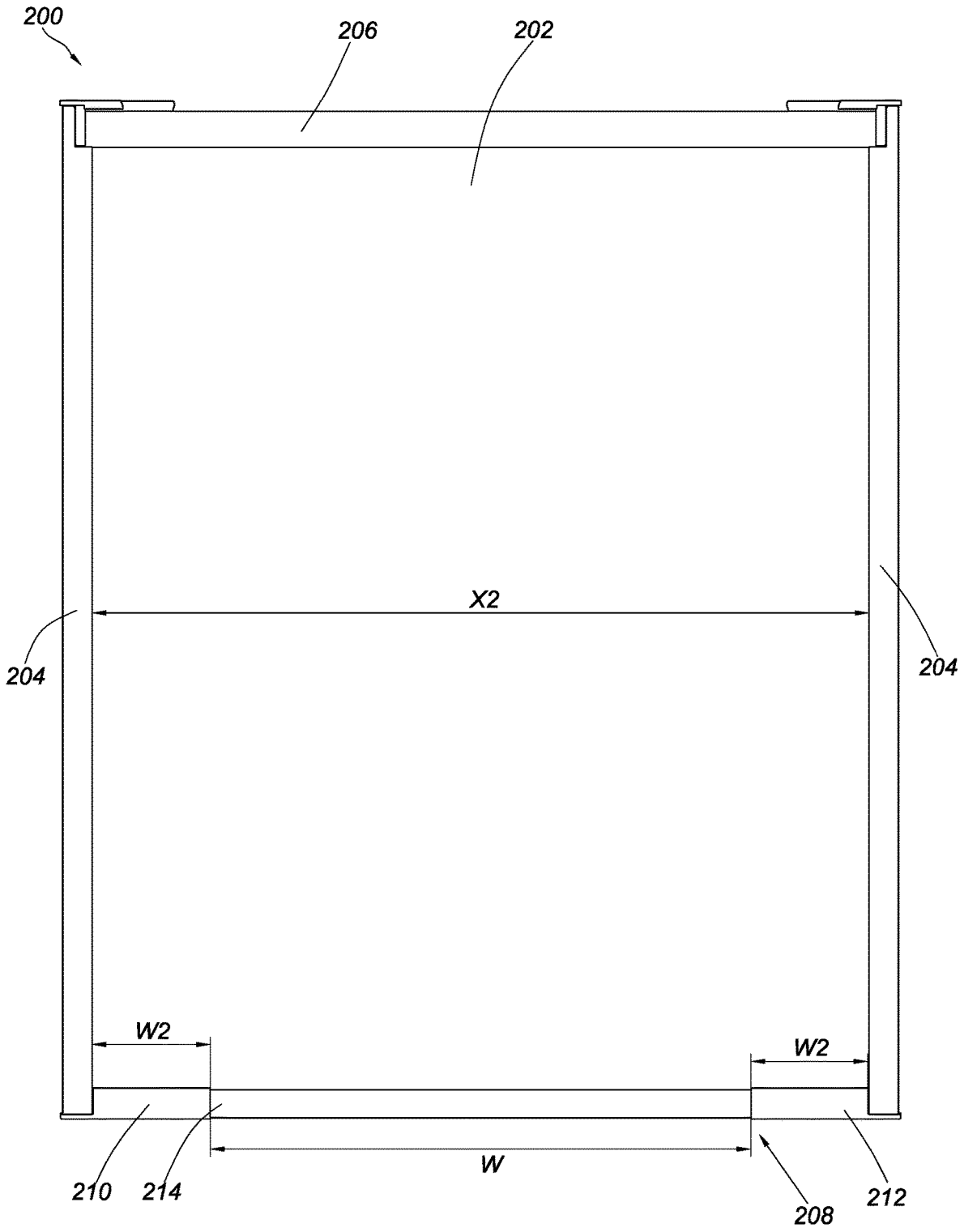
FIG. 11 is a schematic view showing that the second wall of the drawer matches a second drawer width according to another embodiment of the present invention.

In another embodiment as shown in FIG. 11, the bottom panel 202, the pair of first walls 204, the rear wall 206, and the second wall 208 of the drawer 200 jointly define a space. The first portion 210 and the second portion 212 of the second wall 208 are connected to the two lateral sides of the middle portion 214 respectively in the aforesaid threaded manner. The middle portion 214 in this embodiment also has the standard width W, and a user may choose a first portion 210 and a second portion 212 of a second predetermined width W2 in order for the total width of the second wall 208 (mathematically expressed as W+2W2) to match a second width X2 defined by the pair of first walls 204.

It can be known from the above that the foregoing embodiments of the present invention have the following features:

1. A user can mount the mounting device 30 on the second wall 28 without using tools. This tool-free mounting design helps reduce cost or allows the furniture fittings to be assembled and disassembled with ease.
2. Through the mounting device 30, the second wall 28 can be mounted on the connection device 32 of the corresponding first wall 24 in a detachable manner.
3. As the first portion 28*a*/210 and the second portion 28*b*/212 of the second wall 28/208 are respectively and threadedly connected to the two lateral sides of the middle portion 28*c*/214, a user may choose and connect a first portion 28*a*/210 and a second portion 28*b*/212 of a certain predetermined width W1/W2 to the two lateral sides of the middle portion 28*c*/214 respectively, in order for the resulting second wall 28/208 to match the width defined by the pair of first walls 24/204 of the drawer 20/200.

While the present invention has been disclosed through the preferred embodiments described above, those embodiments are not intended to be restrictive of the scope of the invention. The scope of patent protection sought by the applicant is defined by the appended claims.

What is claimed is:

1. A set of furniture fittings, comprising:
a first wall;
a second wall provided with a first structure; and
a mounting device provided with a second structure;
wherein the first structure and the second structure are detachably engaged with each other in a tool-free manner;
wherein one of the second wall and the mounting device includes a projection deflectable to releasably lock the engagement of the first and second structures with one another, the projection being elastically biased to a locking position; and
wherein the second wall is mounted on the first wall through the mounting device.

2. The set of furniture fittings of claim 1, further comprising a connection device disposed on the first wall, wherein the connection device is configured to connect with the mounting device.

3. The set of furniture fittings of claim 2, wherein the mounting device includes a pin, and the connection device includes a fastening member configured to be fastened to the pin.

4. The set of furniture fittings of claim 1, wherein the first wall is a sidewall of a drawer, and the second wall is a front panel of the drawer.

5. The set of furniture fittings of claim 4, wherein the second wall includes a first portion, a second portion, and a middle portion connected between the first portion and the second portion, and one of the first portion and the second portion is provided with the first structure.

6. The set of furniture fittings of claim 5, wherein the projection is a second projection, one of the first structure and the second structure includes a first projection, and the other of the first structure and the second structure includes a hole configured to work with the first projection.

7. The set of furniture fittings of claim 6, wherein the first projection has a first section and a second section bent with respect to the first section, the first projection thereby forming a hooked structure, and the first section and the second section are configured to be inserted into the hole and engage with a hole wall of the hole, the first structure and the second structure being thereby hooked together when releasably locked in engagement.

8. The set of furniture fittings of claim 6, wherein the second projection includes an elastic section and a supporting section connected to the elastic section, and the supporting section is configured to support the other of the second wall and the mounting device.

9. The set of furniture fittings of claim 5, wherein at least one of the first portion and the second portion is threadedly connected to the middle portion.

10. The set of furniture fittings of claim 9, wherein at least one of the first portion and the second portion includes a plate body and a connecting section substantially perpendicularly connected to the plate body, and the connecting section is connected to a lateral side of the middle portion through a screw.

11. A drawer, comprising:
a bottom panel;
a pair of first walls disposed adjacent to two lateral sides of the bottom panel respectively;
a rear wall disposed adjacent to a rear side of the bottom panel;
a second wall disposed adjacent to a front side of the bottom panel and provided with at least one first structure; and
at least one mounting device provided with a second structure,
wherein the second structure of the at least one mounting device is engaged with the at least one first structure of the second wall in a tool-free manner,
wherein one of the second wall and the mounting device includes a projection deflectable to releasably lock the engagement of the first and second structures with one another, the projection being elastically biased to a locking position, and
wherein the second wall is mounted on at least one of the pair of first walls through the at least one mounting device.

12. The drawer of claim 11, further comprising at least one connection device disposed on at least one of the pair of first walls, wherein the at least one connection device is configured to connect with the at least one mounting device.

13. The drawer of claim 12, wherein the at least one mounting device includes a pin, and the at least one connection device includes a fastening member configured to be fastened to the pin.

14. The drawer of claim 11, wherein the pair of first walls are sidewalls of the drawer, and the second wall is a front panel of the drawer.

15. The drawer of claim 14, wherein the second wall includes a first portion, a second portion, and a middle portion connected between the first portion and the second portion, and at least one of the first portion and the second portion is provided with the first structure.

16. The drawer of claim 15, wherein the projection is a second projection, one of the at least one first structure and the at least one second structure includes a first projection, and the other of the at least one first structure and the at least one second structure includes a hole configured to work with the first projection.

17. The drawer of claim 16, wherein the first projection has a first section and a second section bent with respect to the first section, the first projection thereby forming a hooked structure, and the first section and the second section are configured to be inserted into the hole and engage with a hole wall of the hole, the first structure and the second structure being thereby hooked together when releasably locked in engagement.

18. The drawer of claim 16, wherein the second projection includes an elastic section and a supporting section connected to the elastic section, and the supporting section is configured to support the other of the second wall and the at least one mounting device.

19. The drawer of claim 15, wherein at least one of the first portion and the second portion is threadedly connected to the middle portion.

20. The drawer of claim 19, wherein at least one of the first portion and the second portion includes a plate body and a connecting section substantially perpendicularly connected to the plate body, and the connecting section is connected to a lateral side of the middle portion through a screw.

* * * * *